US009981830B2

(12) United States Patent
Dold

(10) Patent No.: US 9,981,830 B2
(45) Date of Patent: May 29, 2018

(54) SUPPORT FOR AN ELEVATOR INSTALLATION

(71) Applicant: Inventio AG, Hergiswil (CH)

(72) Inventor: Florian Dold, Root (CH)

(73) Assignee: INVENTIO AG, Hergiswil (CH)

( * ) Notice: Subject to any disclaimer, the term of this patent is extended or adjusted under 35 U.S.C. 154(b) by 451 days.

(21) Appl. No.: 14/436,135

(22) PCT Filed: Oct. 21, 2013

(86) PCT No.: PCT/EP2013/071910

§ 371 (c)(1),
(2) Date: Apr. 16, 2015

(87) PCT Pub. No.: WO2014/064021

PCT Pub. Date: May 1, 2014

(65) Prior Publication Data

US 2015/0298941 A1 Oct. 22, 2015

(30) Foreign Application Priority Data

Oct. 22, 2012 (EP) ..... 12189368

(51) Int. Cl.

| | |
|---|---|
| ***B66B 1/34*** | (2006.01) |
| ***B66B 3/00*** | (2006.01) |
| ***B66B 19/02*** | (2006.01) |
| ***B66B 7/06*** | (2006.01) |
| ***B66B 7/12*** | (2006.01) |
| ***B66B 5/00*** | (2006.01) |
| ***B66B 7/08*** | (2006.01) |

(52) U.S. Cl.
CPC ..... *B66B 19/02* (2013.01); *B66B 5/0031* (2013.01); *B66B 7/062* (2013.01); *B66B 7/08* (2013.01); *B66B 7/1223* (2013.01)

(58) Field of Classification Search
CPC ..... B66B 19/02; B66B 5/0031; B66B 7/062; B66B 7/08; B66B 7/1223
USPC ..... 181/393
See application file for complete search history.

(56) References Cited

U.S. PATENT DOCUMENTS 7,506,728 B2 * 3/2009 Hawkes ..... B66B 7/1223 187/277
2012/0090924 A1 * 4/2012 Odermatt ..... B66B 7/062 187/251

(Continued)

FOREIGN PATENT DOCUMENTS

CA 2778870 A1 7/2011
DE 3934654 A1 5/1991

(Continued)

*Primary Examiner* — Jeffrey Donels
(74) *Attorney, Agent, or Firm* — William J. Clemens; Shumaker, Loop & Kendrick, LLP

(57) ABSTRACT

A method of providing a support for an elevator car in an elevator installation, wherein the support includes a plurality of tensile carriers arranged parallel to one another and substantially enclosed by a casing, includes pre-preparation of a first support end wherein the tensile carriers are directly electrically contactable at a pre-prepared location by a contacting device, and wherein the pre-preparation is carried out before transport of the support to the elevator installation.

14 Claims, 4 Drawing Sheets

(56) References Cited

U.S. PATENT DOCUMENTS

| | | | | |
|---|---|---|---|---|
| 2013/0153340 | A1* | 6/2013 | Dold | B66B 7/1223 187/393 |
| 2013/0157497 | A1* | 6/2013 | Dold | B66B 7/1223 439/413 |
| 2015/0291394 | A1* | 10/2015 | Dold | B66B 7/062 324/693 |
| 2015/0307323 | A1* | 10/2015 | Zapf | B66B 7/062 187/411 |
| 2015/0336769 | A1* | 11/2015 | Dold | B66B 7/1223 187/393 |
| 2016/0101964 | A1* | 4/2016 | Dold | B66B 19/02 29/593 |

FOREIGN PATENT DOCUMENTS

| | | | |
|---|---|---|---|
| WO | 2005094249 | A2 | 10/2005 |
| WO | 2010057797 | A1 | 5/2010 |
| WO | 2011003791 | A1 | 1/2011 |

* cited by examiner

SUPPORT FOR AN ELEVATOR INSTALLATION

FIELD

The subject of the invention is a method for providing a support means for use in an elevator installation.

BACKGROUND

In many conveying devices such as, for example, elevator installations, cranes or hoists use is made of belt-shaped support means. These support means generally comprise a plurality of tensile carriers which consist of steel wires and which accept the tensile forces to be absorbed by the support means. The tensile carriers are generally surrounded by a casing of synthetic material. The casing protects the tensile carriers from, for example, mechanical wear, since the support means are frequently guided around deflection points. In addition, the casing improves the traction of the support means on deflecting or drive rollers and fixes the arrangement of the tensile carriers relative to one another.

Such support means are a safety-relevant component within a conveying device. Failure or breakage thereof can lead to substantial harm to objects or persons. For this reason, use is made of check units in conveying devices, which check, in particular, the mechanical state of the tensile carriers. Damage of the tensile carriers accepting the forces shall thereby be able to be recognized in good time so that the support means in the case of damage can be exchanged in order to prevent failure of the conveying device.

The electrically conductive, metallic tensile carriers are surrounded by the electrically insulating casing of synthetic material. In order to carry out a check of the state of the tensile carriers contacting of a contact element with the tensile carriers is necessary in some methods. In one known method an electrical current, which serves as a test current for the purpose of ascertaining the state of the tensile carriers, is conducted through the tensile carriers with the help of the contact element.

DE 3 934 654 A1 shows a support means of the category described above. The ends of the tensile carriers are in that case conductively connected in pairs with a bridge member so that the tensile carriers of the support means are electrically connected in series. The tensile carriers of the support means are connected with a voltage source by way of an ammeter so that the state of the tensile carriers can be assessed by means of the test current which is conducted through all tensile carriers by virtue of the electrical connection in series.

WO 2005/094249 A2 shows a system for contacting a support means in which the contact elements puncture the casing of the support means perpendicularly to a longitudinal axis of the tensile carriers and then penetrate into the tensile carriers. It can be disadvantageous in that case that the contact elements due to the required puncturing process through the casing miss the tensile carriers. In addition, a transfer resistance between the tensile carriers and the contact elements penetrated therein can change over time which has a disadvantageous effect on the meaningfulness of a monitoring procedure.

WO 2010/057797 A1 and WO 2011/003791 A1 show systems for contacting a support means in which contact elements are mounted on exposed tensile carriers of the support means, for example by resilient contacts or by contact spikes penetrating into the tensile carriers. It is disadvantageous with such contacting systems that the connection between contact elements and tensile carriers is non-constant and that a high transfer resistance between the contact element and the tensile carriers is present.

SUMMARY

An object of the present invention consists in making available a method of providing a support means for use in an elevator installation, wherein the tensile carriers of the support means are to be reliably electrically contactable.

For fulfillment of this object at the outset a method of providing a support means for use in an elevator installation is proposed. In that case, the support means comprises a plurality of tensile carriers, which are arranged parallel to one another, and a casing, wherein the tensile carriers are substantially enclosed by the casing. The method comprises the steps of pre-preparation of a first support means end, wherein contact elements are arranged at the tensile carriers at a pre-prepared location so that the tensile carriers at the pre-prepared location are directly electrically contactable by a contacting device, wherein the pre-preparation is carried out before transport of the support means to the elevator installation.

Such a method for provision of a support means for use in an elevator installation has the advantage that the support means pre-prepared in that manner can at the time of installation in an elevator installation be connected in simple, reliable and economic mode and manner with a monitoring device. Thus, when the support means is installed in the elevator installation there is no need for special tools or work sequences which can be difficult to check. The installation time of an elevator installation can thereby be reduced and at the same time the quality of the electrical contacting of the tensile carriers improved, because there are no working steps susceptible to error. In addition, the make-up of assembly personnel can be simplified, since there are no complicated working steps.

The pre-preparation of the support means can in principle be carried out in different ways. According to a first embodiment at the time of pre-preparation the tensile carriers are freed at least partly from the casing at the pre-prepared locations. Support means pre-prepared in that manner have the advantage that the at least partly freed tensile carriers can be electrically contacted in simple mode and manner, for example by contact terminals.

At the time of pre-preparation of the support means, contact elements are arranged at the tensile carriers at the pre-prepared locations. Such contact elements have the advantage that they reliably electrically contact the tensile carriers and can in turn be directly and reliably electrically contacted in simple mode and manner by a contacting device. In an advantageous development these contact elements are soldered, welded, glued or press-fitted to the tensile carriers. In a further advantageous development these contact elements project to such an extent from the support means that they are directly and electrically contactable in simple mode and manner by a contacting device.

Such contact elements can in a first embodiment be arranged at tensile carriers freed at least partly from the casing, i.e. after extrusion of the casing onto the tensile carriers. In an alternative embodiment the contact elements are arranged at the tensile carriers before these are enclosed by a casing. The contact elements are in that case advantageously constructed in such a manner that they protrude from the casing after the casing has been extruded around the tensile carriers. In this way the tensile carriers can be directly electrically contacted at the pre-prepared location.

In an advantageous embodiment the pre-prepared location is so dimensioned that this can be guided through a support means fastening device. Locations pre-prepared in that manner have the advantage that a correspondingly provided support means can at the time of installation of the support means in an elevator installation be fastened in an elevator installation like a conventional support means. There is thus no need for specially produced support means fastening devices, which are constructed for support means with pre-prepared locations of larger dimension.

If covers are provided at deflecting and/or drive rollers the pre-prepared location is advantageously similarly dimensioned in such a manner that this can be guided through under such covers.

In an advantageous embodiment the method for providing a support means for use in an elevator installation comprises the additional step of mounting a protective element at the pre-prepared location.

Such a protective element offers the advantage that the pre-prepared location during transport and/or storage and/or installation of the support means is protected from mechanical loads. Thus, for example, contact elements mounted at the tensile carriers are protected by a synthetic material element from mechanical influences.

In an advantageous development such a protective element can be mounted on and removed from the pre-prepared location of the support means in simple mode and manner. In an alternative development such a protective element is permanently mounted on the pre-prepared location so that the protective element remains at the support means even when the support means is used in an elevator installation. In that case the protective element can have cut-outs which allow simple contacting of the tensile carriers by a contacting device.

In a first advantageous embodiment only one support means end of the support means is pre-prepared. In order to ensure monitoring of a support means pre-prepared at one end the tensile carriers are at the time of installation of the support means in an elevator installation electrically connected together at a side of the support means which is not pre-prepared. This can be achieved, for example, by a knife-shaped contact element or by screw-like connecting elements, which in each instance electrically connect together two adjacent tensile carriers. The advantage of such a method resides in the fact that a support means pre-prepared at merely one end can be cut to length at the time of installation of the support means.

In a second exemplifying form of embodiment the two support means ends of the support means are pre-prepared in such a manner that the tensile carriers are directly electrically contactable at the pre-prepared locations by a contacting device, wherein the pre-preparation is carried out before transport of the support means to the elevator installation. Such a method for provision of a support means for use in an elevator installation has the advantage that at the time of installation of the support means in an elevator installation there is no need to carry out complicated working steps susceptible to error. A support means pre-prepared in that manner at both ends is advantageously cut to length before transport of the support means to the elevator installation. The cutting to length can therefore be carried out at the time of pre-preparation so that the support means can be cleanly cut. In the case of cutting to length of the support means in the elevator installation it is not possible to use heavy and expensive cutting means, which in certain circumstances do not allow clean cuts to be made. However, a disadvantage of support means pre-prepared at both ends in that manner is that a certain degree of margin for the length of the support means has to be computed in, which ultimately results in an excess length of the support means in the elevator installation. Opposing that are the advantages of improved electrical contacting and improved cutting.

In an advantageous development a distance between the pre-prepared locations is greater than a required support means length in the elevator installation between a first and a second support means fastening device. This has the advantage that the length of the support means pre-prepared at both ends is sufficient even in the case of slight inaccuracies which arise. In an advantageous development the distance between the pre-prepared locations is greater by 50 to 1,000 centimeters, preferably by 100 to 500 centimeters, particularly preferably by 150 to 300 centimeters, than the required support means length in the elevator installation between the first and the second support means fastening devices.

In an advantageous embodiment the method comprises the further steps of installing the support means in the elevator installation, wherein the support means is fastened to support means fastening devices and wherein the pre-prepared location is electrically connected with a contacting device, and wherein the contacting device is connected with a monitoring unit, and monitoring the support means on the basis of electrical characteristic values of the tensile carriers.

In an advantageous embodiment at the time of installing the support means in the elevator installation at least two tensile carriers are electrically connected together at a second support means end. This has the advantage that the support means can be cut to length at the time of installation so that there is no excess length. Thereagainst, it is disadvantageous that in each instance at least two tensile carriers have to be electrically connected together at a non-pre-prepared location of the support means without in that case being able to resort to pre-prepared locations. Since the tensile carriers at the second support means end do not have to be individually electrically contacted this disadvantage can be taken into account, because a pure electrical connection of two tensile carriers is less complicated and less susceptible to error than an individual electrical measuring of the tensile carriers.

In an alternative advantageous embodiment during the pre-preparation not only the first support means end, but also a second support means end are pre-prepared in such a manner that the tensile carriers at the pre-prepared locations are directly electrically contactable by a contacting device, wherein the pre-preparation takes place before transport of the support means to the elevator installation. Such a method has the advantage that at the time of installation of the support means in the elevator installation it is merely necessary to electrically contact pre-prepared locations, which simplifies electrical contacting of the tensile carriers and improves the quality of the electrical contacts.

In an advantageous development at the time of installation of the support means in the elevator installation in each instance at least two tensile carriers are electrically connected together by a second contacting device at the second support means end, and the tensile carriers are individually electrically measured by a first contacting device at the first support means end. In that case the pre-preparation at the first and second support means ends can be formed to be identical or the pre-preparation at the first and second support means ends can be formed to be different.

In an exemplifying form of embodiment at the time of installation of the support means in the elevator installation the support means is fastened in such a manner to the support means fastening devices that an excess length of the support means is stored substantially behind only one support means fastening device. This has the advantage that the excess length has to be stored only once in the elevator installation. This reduces cost at the time of installation of the support means in the elevator installation. In an advantageous development the excess length of the support means is rolled up and fastened to a support.

In an exemplifying form of embodiment at the time of installation of the support means in the elevator installation the pre-prepared location is guided through the support means fastening device. Advantageously, in that case the pre-prepared location is dimensioned in such a manner that there is no need to use special support means fastening devices.

In an advantageous embodiment the tensile carriers comprise stranded steel wires. In an alternative form of embodiment the tensile carriers comprise stranded synthetic material fibers such as, for example, aramid fibers, and electrically conductive elements such as, for example, carbon fibers or metallic wires.

The terms "pre-preparation" and "pre-prepared location" mean that the support means is readied with respect to electrical contacting of the tensile carriers. A pre-prepared location accordingly differs from a non-pre-prepared location of the support means in that a contacting device can be electrically connected more simply or more directly with the tensile carriers. Pre-preparation can thus include mounting of additional elements or, however, also merely a change of the casing or of the tensile carriers.

DESCRIPTION OF THE DRAWINGS

Details and advantages of the invention are described in the following by way of embodiments and with reference to schematic drawings, in which.

DETAILED DESCRIPTION

Figure 1:
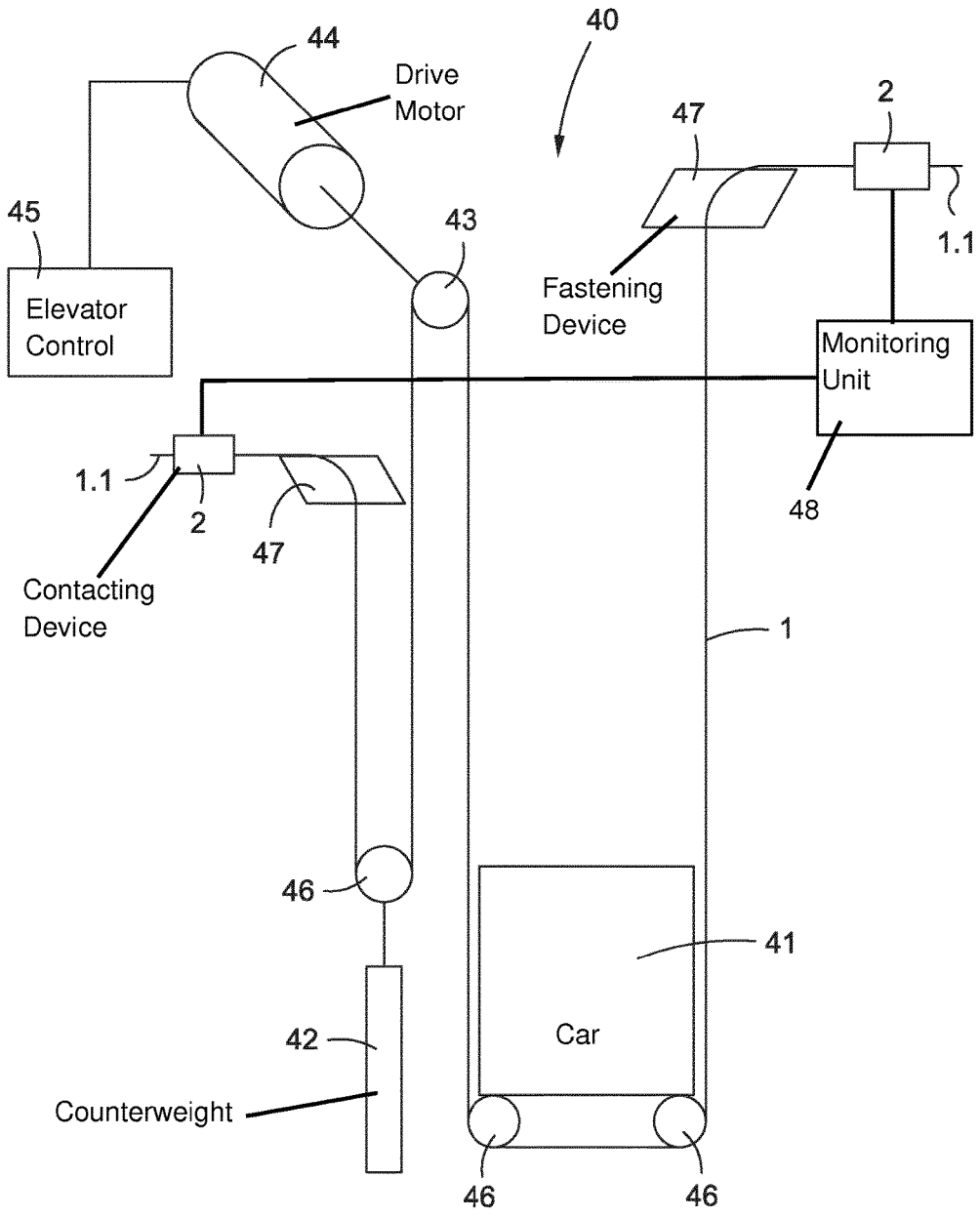
FIG. 1 shows an exemplifying form of embodiment of an elevator installation.

The elevator installation 40 illustrated schematically and by way of example in FIG. 1 includes an elevator car 41, a counterweight 42 and a support means 1 as well as a drive pulley 43 with associated drive motor 44. The drive pulley 43 drives the support means 1 and thus moves the elevator car 41 and the counterweight 42 in opposite sense. The drive motor 44 is controlled by an elevator control 45. The car 41 is designed to receive persons and/or goods and to transport them between floors of a building. The car 41 and counterweight 42 are guided along guides (not illustrated). In the example the car 41 and the counterweight 42 are each suspended at support rollers 46. The support means 1 is in that case fixed at a first support means fastening device 47 and then guided initially around the support roller 46 of the counterweight 42. The support means 1 is then laid over the drive pulley 43, guided around the support rollers 46 of the car 41 and finally connected by a second support means fastening device 47 with a fixing location. This means that the support means 1 runs over the drive 43, 44 at a speed which is higher, in correspondence with a suspension factor, than the car 41 and counterweight 42 move. In the example the suspension factor is 2:1.

A free end 1.1 of the support means 1 is provided with a contacting device 2 for temporary or permanent contacting of the support means 1. In the illustrated example a contacting device 2 of that kind is arranged at both ends of the support means 1. In an alternative form of embodiment (not illustrated) only one contacting device 2 is arranged at one of the support means ends 1.1. The support means ends 1.1 are no longer loaded by the tension force in the support means 1, since this tension force is already conducted in advance into the building by way of the support means fastening devices 47.

The contacting devices 2 are thus arranged in a region, which is not rolled over, of the support means 1 and outside the loaded region of the support means 1. The contacting devices 2 are electrically connected with a monitoring unit 48 for checking the electrical resistance of individual tensile carriers in the support means 1.

The illustrated elevator installation 40 in FIG. 1 is by way of example. Other suspension factors and arrangements such as, for example, elevator installations without a counterweight are possible. The contacting device 2 for contacting the support means 1 is then arranged in correspondence with the positioning of the support means fastening devices 47.

Figure 2:
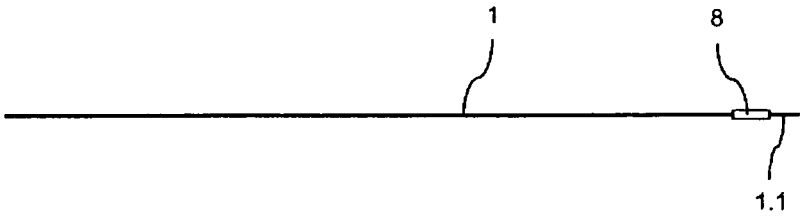
FIG. 2 shows an exemplifying form of embodiment of a pre-prepared support means.

A support means 1 with a pre-prepared location 8 at a first support means end 1.1 is illustrated in FIG. 2. According to a first embodiment the support means is pre-prepared only at one end, so that the support means can at the time of installation in elevator installation be cut to length. In that case, in each instance at least two tensile carriers are electrically connected together at a non-pre-prepared second support means end so that in each instance at least two tensile carriers are connectible in series, wherein the tensile carriers have to be electrically contacted or measured only at the first support means end by a monitoring unit.

Figure 3:
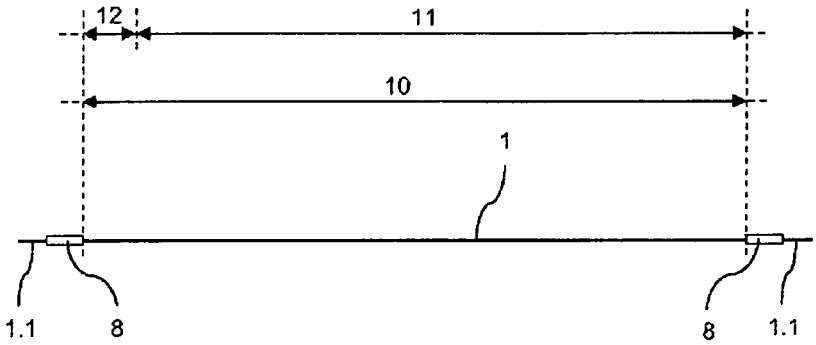
FIG. 3 shows an exemplifying form of embodiment of a pre-prepared support means.

A support means 1 pre-prepared at both ends is illustrated in FIG. 3. In that case, the pre-prepared locations 8 are located at a first and a second support means end 1.1. A distance 10 between the pre-prepared locations 8 comprises a necessary support means length 11 and an excess length 12. In that case, the necessary support means length 11 amounts to an expected support means length between two support means fastening devices in the elevator installation and the excess length 12 serves as a safety margin. The excess length 12 can then be, for example, between 50 and 1,000 centimeters, preferably between 100 and 500 centimeters, particularly preferably between 150 and 300 centimeters.

Figure 4:
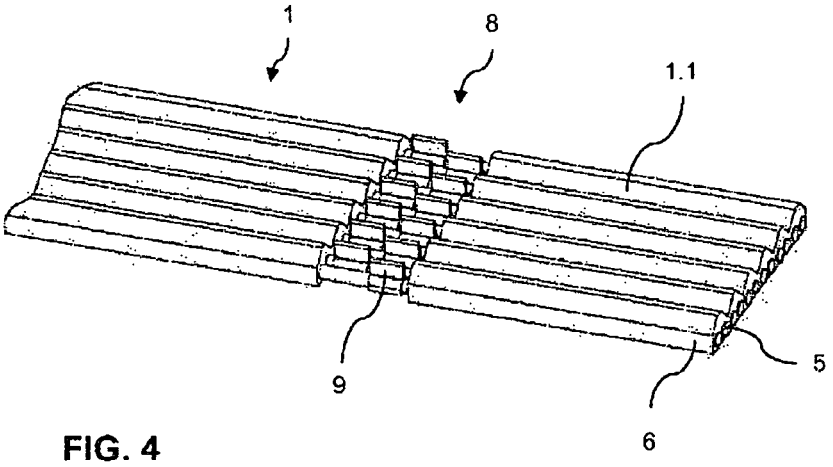
FIG. 4 shows an exemplifying form of embodiment of a pre-prepared support means end.

An exemplifying form of embodiment of a pre-prepared support means end 1.1 is illustrated in FIG. 4. The support means 1 in that case comprises tensile carriers 5 arranged parallel to one another and a casing 6, wherein the tensile carriers 5 are substantially enclosed by the casing 6. The tensile carriers 5 are freed at least partly from the casing 6 at the pre-prepared location 8 and in addition contact elements 9 are arranged at the tensile carriers 5. Such contact elements 9 allow a simple and secure electrical contacting of the tensile carriers by a contacting device.

Figure 5:
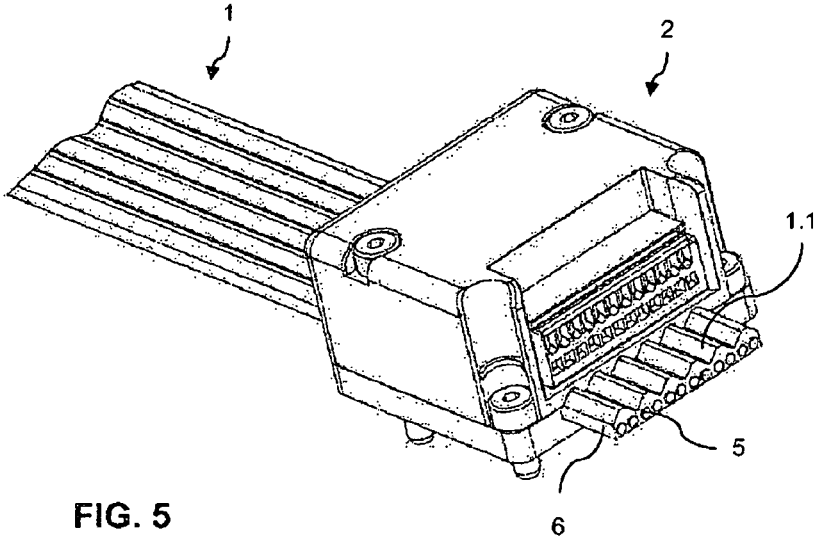
FIG. 5 shows an exemplifying form of embodiment of a pre-prepared support means end with a contacting device.

An exemplifying form of embodiment of a support means end 1.1 with a contacting device 2 is illustrated in FIG. 5. The support means 1 again comprises tensile carriers 5 arranged parallel to one another and a casing 6, wherein the tensile carriers 5 are substantially enclosed by the casing 6. The contacting device 2 is arranged on the pre-prepared location (not visible). In this embodiment the contacting device comprises a base and a cover, which facilitate mounting of the contacting device at the pre-prepared location.

The contacting device 2 additionally comprises a plug strip so that the contacting device 2 and thereby the tensile carriers 5 can be electrically connected in simple mode and manner with the monitoring unit (not illustrated).

Figure 6:
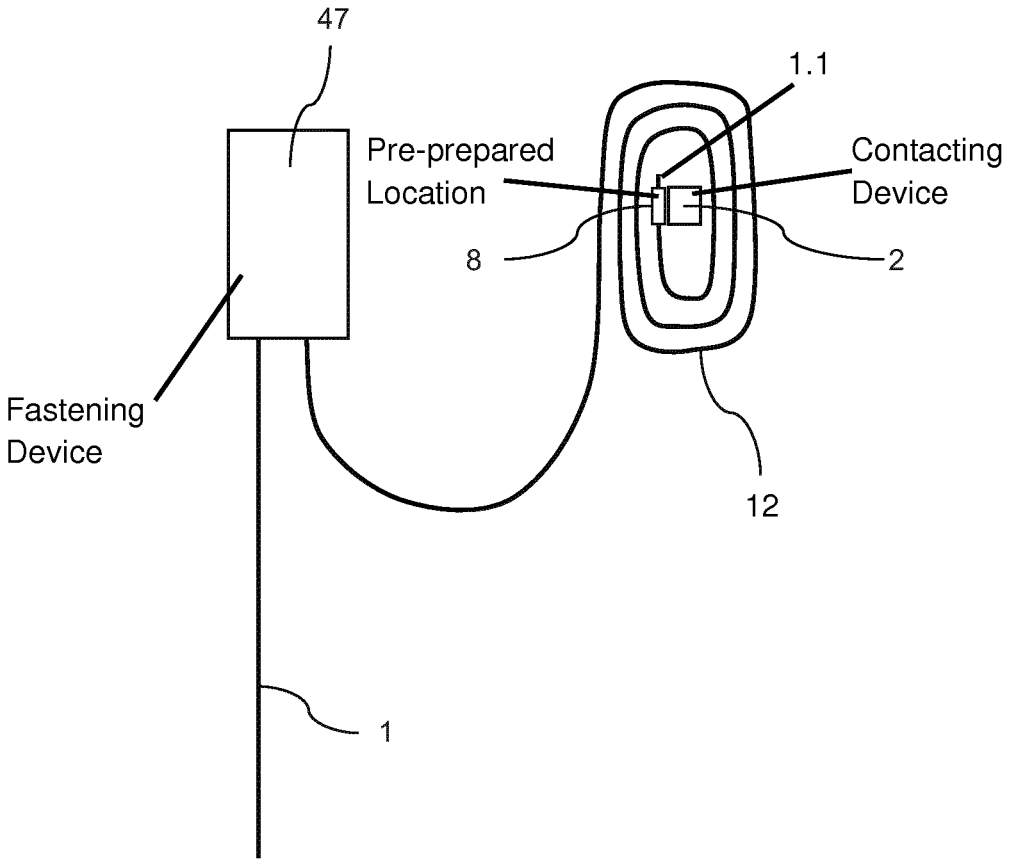
FIG. 6 shows an exemplifying form of embodiment of a pre-prepared support means end with excess length.

An exemplifying form of embodiment of a support means 1, which is fastened to a support means fastening device 47, with an excess length is illustrated in FIG. 6. The support means end 1.1 again comprises a pre-prepared location 8 and a contacting device 2 arranged at the pre-prepared location 8. The excess length 12 arising due to pre-preparation at two ends and creating an intended margin is, in this embodiment, rolled up. The rolled-up excess length and/or the pre-prepared location 8 can in that case be fastened to a support (not illustrated) in the elevator installation.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method of providing a support for use in an elevator installation, the support having a plurality of tensile carriers arranged parallel to one another and a casing, wherein the tensile carriers are substantially enclosed by the casing, the method comprising the steps of:

pre-preparing a first support end of the support by arranging contact elements at the tensile carriers at a pre-prepared location along the support so that the tensile carriers are directly electrically contactable through the contact elements at the pre-prepared location by a contacting device; and carrying out the pre-preparing step before transport of the support to the elevator installation.

2. The method according to claim 1 including during the pre-preparing step freeing the tensile carriers at least partly from the casing at the pre-prepared location.

3. The method according to claim 1 including dimensioning the pre-prepared location to be guidable through a support fastening device.

4. The method according to claim 1 including a step of mounting a protective element on the support at the pre-prepared location.

5. The method according to claim 1 including performing the pre-preparation steps on a second support end of the support.

6. The method according to claim 5 wherein a distance between the pre-prepared locations of the first and second support ends is greater than a required support length between a first support fastening device and a second support fastening device in the elevator installation.

7. The method according to claim 6 wherein the distance is in a range of 50 to 1,000 centimeters greater than the required support length.

8. The method according to claim 1 including the further steps of:

installing the support in the elevator installation by fastening at support fastening devices;

electrically connecting the tensile carriers at the pre-prepared location to the contacting device wherein the contacting device is connected with a monitoring unit; and monitoring the support with the monitoring unit by detecting electrical characteristic values of the tensile carriers.

9. The method according to claim 8 wherein when the support means is installed in the elevator installation at least two of the tensile carriers are electrically connected together at a second support end of the support.

10. The method according to claim 8 including performing the pre-preparation steps on a second support end of the support.

11. The method according to claim 10 wherein the contacting device is a first contacting device, wherein when the support is installed in the elevator installation at least two of the tensile carriers are electrically connected together by a second contacting device at the second support end and wherein the tensile carriers are individually electrically measured at the first support end through the first contacting device.

12. The method according to claim 8 wherein when the support is installed in the elevator installation and the support is fastened to the support fastening devices, an excess length of the support is stored behind one of the support fastening devices.

13. The method according to claim 12 wherein the excess length of the support is rolled up and fastened in the elevator installation.

14. The method according to claim 8 wherein when the support is installed in the elevator installation the pre-prepared location is guided through the support fastening device.

* * * * *